US005397017A

United States Patent [19]

Muza et al.

[11] Patent Number: 5,397,017

[45] Date of Patent: Mar. 14, 1995

[54] PILL DISPENSER CAP

[76] Inventors: Robert Muza; Merry Muza, both of 1621 Cambridge, Kansas City, Mo. 64126

[21] Appl. No.: 108,445

[22] Filed: Aug. 19, 1993

[51] Int. Cl.[6] ..... G07F 11/40

[52] U.S. Cl. ..... 221/91; 221/69; 221/96; 221/98; 221/83; 221/199; 215/228; 222/192; 206/538; 220/212; 220/521; 220/525

[58] Field of Search ..... 221/199, 265, 69, 96, 221/98, 246, 256, 101, 91, 82, 83, 86; 215/228; 222/130, 192; 206/538, 539, 533; 220/212, 521, 525, 526

[56] References Cited

U.S. PATENT DOCUMENTS

| | | | |
|---|---|---|---|
| 2,543,427 | 2/1951 | Warne | 220/212 X |
| 2,762,674 | 9/1956 | Sauvago | 220/525 X |
| 2,766,796 | 10/1956 | Tupper | 220/521 |
| 3,326,360 | 6/1967 | Lyon | 206/533 |
| 3,367,484 | 2/1968 | Nelson | 206/538 X |
| 3,446,179 | 5/1969 | Bender | 220/521 X |
| 4,460,106 | 7/1984 | Moulding, Jr. et al. | 221/265 X |
| 4,583,667 | 4/1986 | Fishman et al. | 206/538 X |
| 4,765,379 | 8/1988 | Szymanski | 206/538 X |
| 4,923,702 | 5/1990 | Powell et al. | 220/521 |
| 4,951,839 | 8/1990 | Kong | 222/192 X |

FOREIGN PATENT DOCUMENTS

| | | | |
|---|---|---|---|
| 1558412 | 1/1969 | France | 222/192 X |

*Primary Examiner*—Robert P. Olszewski
*Assistant Examiner*—Dean A. Reichard
*Attorney, Agent, or Firm*—Spencer, Frank & Schneider

[57] ABSTRACT

A pill dispenser includes at least one closeable chamber for storing pills therein, and threads for attaching the pill dispenser to the opening of a drinking fluid container such that the dispenser serves as a cap for the container.

8 Claims, 3 Drawing Sheets

PILL DISPENSER CAP

BACKGROUND OF THE INVENTION

The present invention relates generally to a pill dispenser, and has particular utility in the storage and dispensing of medicinal or nutritional supplement pills that must be taken orally.

The number of individuals who take medicinal or nutritional supplement pills is in the range of millions. Almost all of those individuals, at one time or another, have to ingest such pills where a source of drinking fluid is not readily available, or where a container for holding drinking fluid is readily not at their disposal.

Among the above individuals, those who travel or commute, and who need to take different assortments of pills at different times, are usually more inconvenienced than others, as they often have to carry with them both a drinking fluid container, and one or more separate pill dispensers. This arrangement can consume much space if a number of different dispensers are being carried. The arrangement also creates the inconvenience of having to locate the separate fluid container and medicine when it is necessary to take the medicine.

SUMMARY OF THE INVENTION

It is an object of the present invention to provide a practical and convenient dispenser for storing and dispensing pills.

It is another object of the present invention to provide a space saving pill dispenser which is readily attachable to the bottleneck of a water bottle, thus serving as a cap for the bottle.

It is yet another object of the present invention to provide a practical and convenient pill dispenser which obviates the difficulty of carrying a water bottle separately from pills.

These objects and others to become apparent as the specification progresses are accomplished by the present invention, according to which, briefly stated, a pill dispenser includes at least one closeable chamber for storing pills therein, and means for attaching the pill dispenser to the opening of a drinking fluid container. The present invention further contemplates attaching the pill dispenser to the opening of a drinking fluid container such that the dispenser serves as a cap therefor.

BRIEF DESCRIPTION OF THE DRAWINGS

The foregoing objects of the invention, together with other objects and advantages which may be attained by its use, will become more apparent upon reading the following detailed description of the invention taken in conjunction with the drawings. In the drawings, where like reference numerals identify corresponding components.

DETAILED DESCRIPTION OF THE INVENTION

Figure 1:
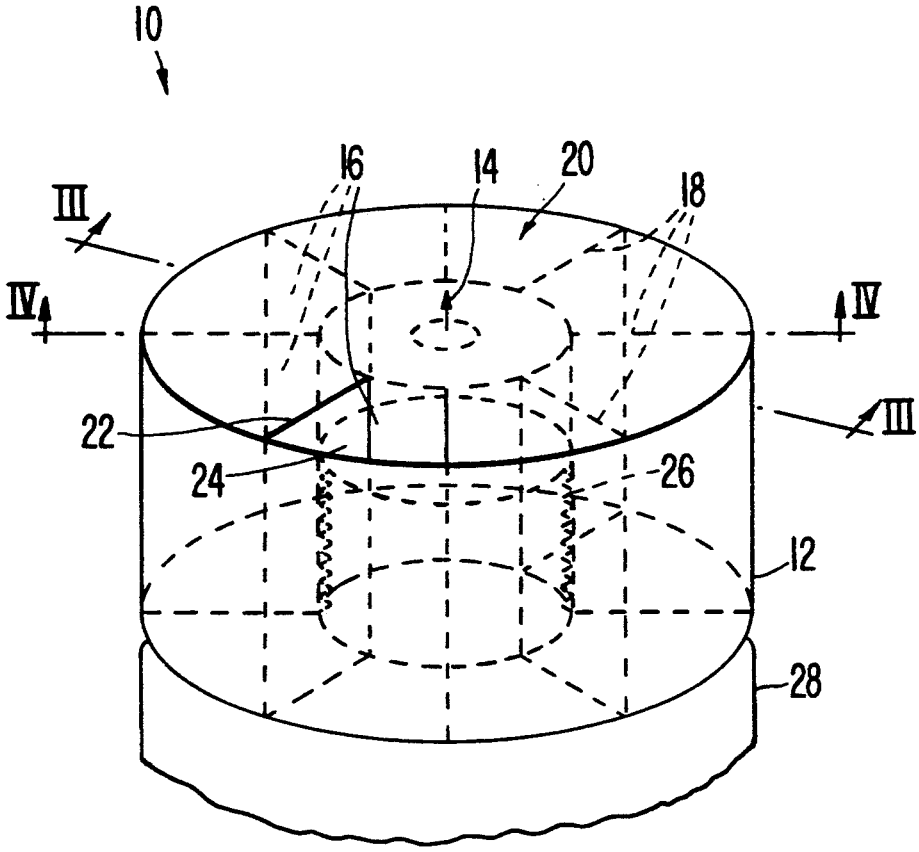
FIG. 1 is a diagrammatic representation of a pill dispenser according to a preferred embodiment of the present invention, the pill dispenser having been attached to the bottleneck of a water bottle.
Figure 2:
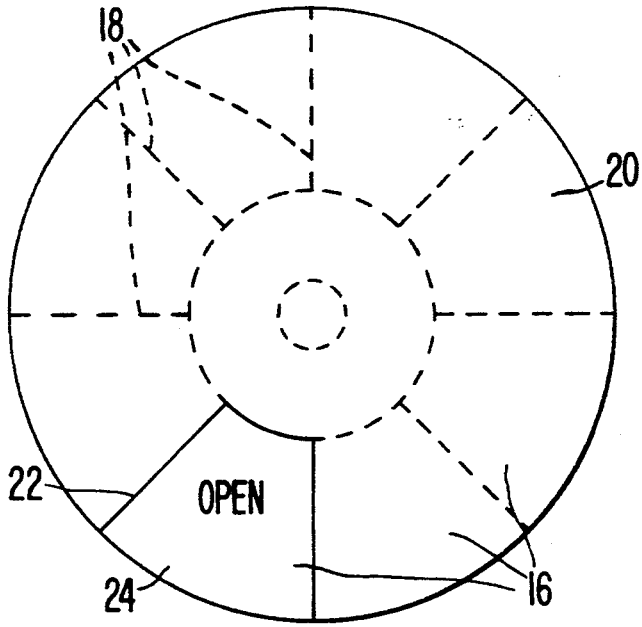
FIG. 2 is a top plan view of the pill dispenser shown in FIG. 1.

Referring now to FIGS. 1 and 2, a pill dispenser 10 is shown having a cylindrical body 12 and a corresponding longitudinal axis 14. Cylindrical body 12 encloses a plurality of pill chambers 16 separated by partitions 18. Although only three of the pill chambers and partitions have been indicated with reference numerals in FIGS. 1 and 2, it is to be understood that the pill chambers and partitions extend about the circumference of pill dispenser 10, as clearly shown in the drawings. In the shown preferred embodiment of the present invention, pill dispenser 10 comprises a total of eight pill chambers 16 configured and dimensioned identically and disposed symmetrically with respect to longitudinal axis 14. One of the chambers, however, is not used for pills as will be explained in greater detail.

Pill chambers 16 are covered by a disc-shaped lid 20 rotatably attached to cylindrical body 12, as will be described in further detail in relation to FIGS. 3, 4, and 5 below. Lid 20 includes an opening 22 therein, and is rotatable about longitudinal axis 14 such that lid opening 22 can be brought into registration with any given one of the pill chambers 16, the lid opening thereby allowing access to an interior space 24 of each chamber with which it has been successively brought into registration. FIG. 1 further shows pill dispenser 10 as having been attached to the opening 26 of a fluid container 28. In the shown preferred embodiment of the invention, container 28 is a seven ounce water bottle, having an externally threaded neck at one end, as is conventional, with the opening 26 located at the end of the threaded neck, also as is conventional.

Figure 3:
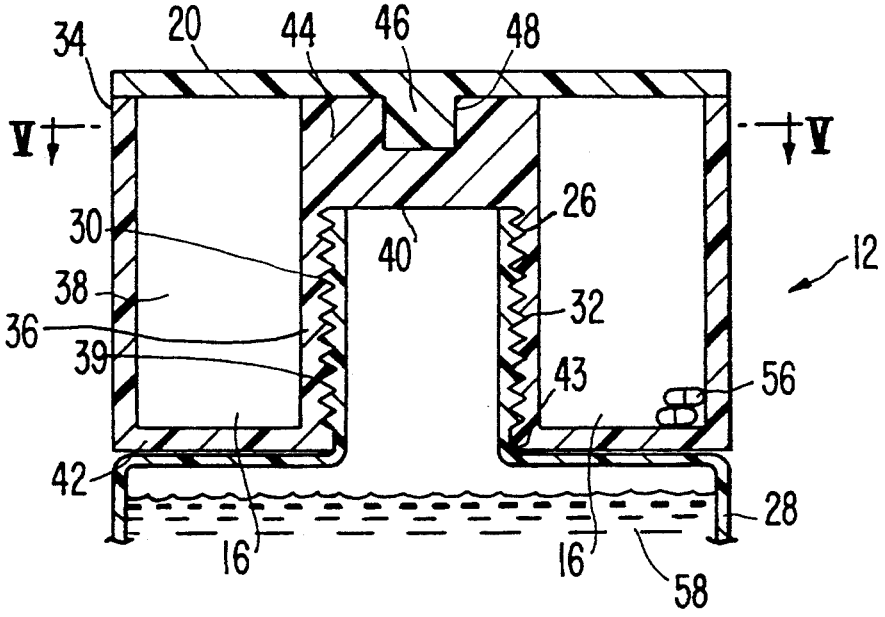
FIG. 3 is a sectional side elevational view of the pill dispenser in FIG. 1 taken along lines III—III, with pills shown as being stored within the dispenser.
Figure 4:
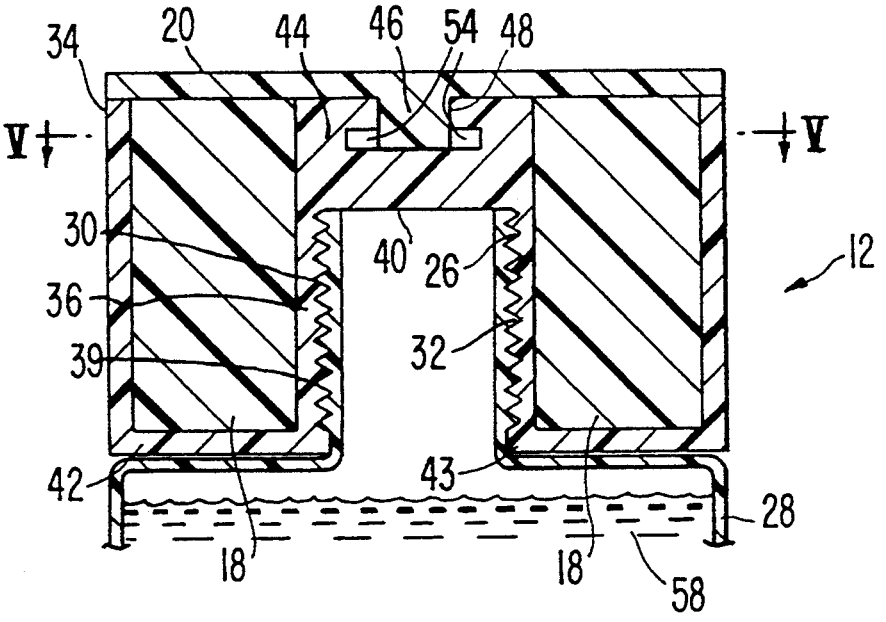
FIG. 4 is a sectional side elevational view of the pill dispenser in FIG. 1 taken along lines IV—IV.
Figure 5:
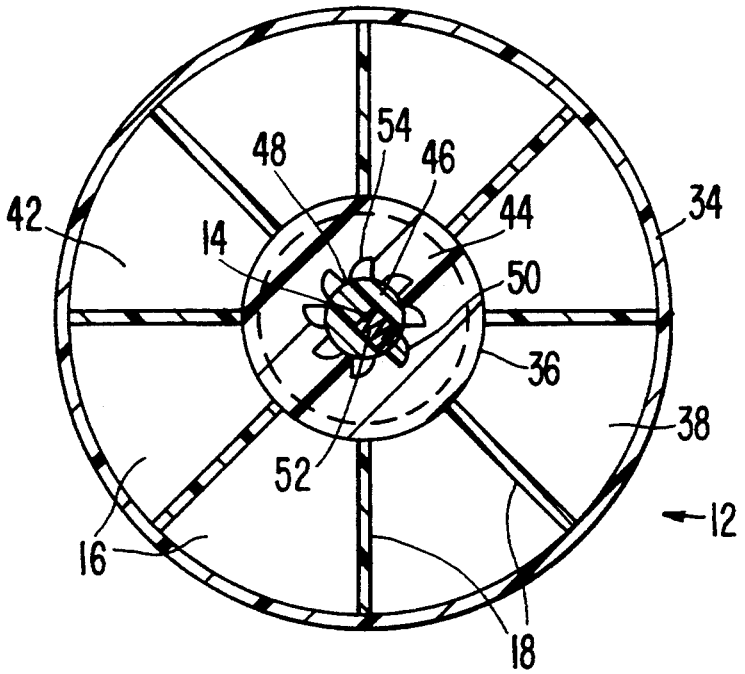
FIG. 5 is a sectional plan view of the pill dispenser in FIG. 4 taken along lines V—V.

FIGS. 3, 4, and 5 show the structure of the pill dispenser 10 in further detail.

In FIGS. 3 and 4, the pill dispenser is shown as having an internally threaded portion 30 thereon for threadably engaging the pill dispenser to a corresponding threaded portion 32 on container opening 26. Cylindrical body 12 of pill dispenser 10 is shown in FIGS. 3, 4, and 5 as including respective first and second coaxial cylinders 34 and 36 defining a cylindrical annular region or annulus 38 therebetween. Second coaxial cylinder 36 has a smaller diameter than first coaxial cylinder 34 and thus cylinders 34 and 36 may be considered as outer and inner cylinders, respectively. Inner cylinder 36 has a surface on the opposite side of the cylinder from annulus 38, which is thus radially inwardly, a surface or wall. 39 provided with a threaded portion 30 thereon. These threads 30 are provided so that the dispenser may be secured to the external threads 32 on the container 28. At the top of cylinder 36, a transverse capping surface 40 is provided as a closure for sealing the container opening 26 when the pill dispenser 10 is attached to the container and securely threaded thereto until the surface 40 tightly abuts the opening 26 such as in a liquid sealing relationship. Surface 40 thus prevents any fluid contained within container 28 from being accidentally released from the container.

Cylindrical annular region 38 is divided into distinct pill chambers by radially extending partitions 18, and is bounded at one end thereof by lid 20, and at the other end thereof by a disc-shaped annular base wall 42. Partitions 18 may be either integral with or distinct from the two coaxial cylinders. The pill dispenser of the present invention is configured as an inverted "U" as seen in a front sectional view, such that the container 28 extends between the "legs" of the inverted "U".

Means are provided for attaching the lid 20 to the cylindrical body 12 and for controlling and limiting movement of the lid. In one embodiment of the invention, lid 20 is shown in FIGS. 3 and 4 as attached to a central portion of cylindrical body 12 on a lid attachment block 44 which extends upwardly from surface 40. The attachment of the lid 20 to the body 12, according to the illustrated embodiment is effected, as schematically shown in FIGS. 3, 4, and 5, by inserting, and preferably force-fitting a projection 46 provided on the underside or lower surface of lid 20 into a receptacle 48 formed in lid attachment block 44. This will be explained in greater detail.

As shown in the embodiment of FIGS. 4 and 5, a tooth mechanism is provided as part of projection 46 and a mating series of grooves or slots are provided in receptacle 48 to rotatably secure lid 20 to cylindrical body 12, and to prevent the lid from being inadvertently rotated out of registration with a given chamber. As shown in FIG. 5, projection 46 is provided with a single tooth 50 having a leading curved side and a trailing flat side thereon, and with the tooth being urged radially outwardly by a spring 52 mounted within projection 46. Tooth 50 is sequentially received within each one of correspondingly shaped, mating grooves 54 provided in surface of the receptacle 48. In the arrangement described, lid 20 can only be rotated in one direction, which will be counterclockwise if the tooth 50 is oriented as illustrated in FIG. 5. Specifically, the lid may be rotated such that the curved edge of the tooth will be forced inwardly to compress the spring 52 by the abutment of the curved edge of the groove. However, if the lid is attempted to be rotated such that the flat edge of the tooth contacts the flat edge of the groove, the flat side of tooth 50 prevents the tooth from being urged into the grooves 54. By locating the grooves equidistant around the circumference of the receptacle 48, and by providing the same number of grooves as there are chambers, the projecting tooth and groove mechanism also serves as a means to align and lock lid opening 22 into position above any given chamber, since lid 20 can be rotated only if enough force is applied to the lid in order to overcome the force of spring 52.

It may be appreciated that, as an alternative to the disclosed embodiment, the tooth can be provided on the receptacle 48, and the grooves provided in projection 46. Furthermore, instead of the projection being provided on the lid and the receptacle being provided in the attachment block, the lid itself can be configured to include a receptacle for receiving a corresponding projection provided on the attachment block.

In another embodiment of the present invention, instead of the tooth and groove mechanism, small projections can be provided on the bottom surface of the lid in order to act as stops against partitions 18, thus locking the lid in place as described above. These projections can be configured to recede into the lid in the manner described above for tooth 50 in order to allow the lid to lock into position. Alternatively, the projections can be provided on the top edge of partitions 18 facing the bottom surface of lid 20 and be made to recede into the partitions. Yet another alternative is to provide small projections which do not move, where the resistance of the projections must be overcome by a rotating force applied to the lid.

The operation of the pill dispenser of the present invention will now be explained. In operation, the pills to be dispensed, such as pills 56 shown in FIG. 3, are distributed among their respective pill chambers 16. Because of the opening 22 in the lid 20, however, all eight chambers can not be used since any pills in the chamber beneath the opening 22 would be inadvertently dispensed upon movement of the pill dispenser. Each chamber to be filled is selected for example for the purpose of storing a specific kind of pill therein. Each chamber to be filled could also be selected for the storage of pills that must be taken at a given time within the day or at a given day of the week. The shown preferred embodiment of the present invention is particularly useful for the latter purpose, where seven of the eight chambers could be labeled for example as representing a given weekday. The pill dispenser of the present invention thus provides a practical and convenient means for storing and dispensing pills. Regardless of how the pills are to be distributed among the chambers, the lid is rotated so that opening 22 is sequentially placed in registration above a chamber, and the pills for that chamber are thereafter inserted through the opening and into the chamber. After all chambers are filled, the lid is again rotated such that the opening 22 is aligned above an empty chamber. When it is desired to remove pills from a given chamber, the lid is again rotated until the opening 22 is aligned above the chamber from which pills are to be removed.

If the container 28 is provided with its own cap, this cap must of course, be removed before the container is filled with a drinking fluid 58, such as water. The pill dispenser is thereafter attached to the container by gripping the dispenser cylindrical body 12, and bringing chambers down around the neck such that threads 32 on the container engage threads 30 on the dispenser. The dispenser is tightly threaded onto the container until opening 26 on the neck is securely closed by capping surface 40. Pill dispenser 10 in this way serves as a cap for the opening of a drinking fluid container in addition to providing a means for storing and dispensing pills. It is important to note that the steps of filling the pill chambers and capping the water bottle can be performed in either order.

The container and pill dispenser combination thus assembled can be easily carried in a purse, or even pocket, particularly if the container is of small size, such as a seven ounce capacity bottle, without the inconvenience of carrying a separate bottle and pill dispenser.

At any time when the pills stored within pill dispenser 10 are to be taken orally, lid 20 is gripped and rotated until lid opening 22 is brought into registration with the desired pill chamber such that the appropriate pills can be removed therefrom, as described above in relation to FIGS. 1 and 2. In order to have access to drinking fluid 58 for swallowing the pills, pill dispenser 10 is unscrewed from the neck and removed therefrom such that drinking fluid 58 can be dispensed from the neck opening 26.

Preferably the lid 20 will be formed of high impact styrene and the remainder of the dispenser will be formed of a high density polyethylene.

The foregoing is a complete description of the present invention. Various changes may be made without departing from the spirit and scope of the invention. The invention, therefore, should be limited only by the scope of the claims which follow.

What is claimed is:

1. A pill dispenser comprising:

at least one chamber for storing pills;

means for selectively opening and closing said chamber such that when said chamber is open, access is provided to an interior of said chamber, and when said chamber is closed, said interior space defines an enclosure;

means for attaching said pill dispenser to a drinking fluid bottle, said bottle having an opening for dispensing drinking fluid therefrom, said opening being at an end of a threaded neck on said bottle, said means for attaching including a threaded portion on said pill dispenser for threadably engaging said pill dispenser with a corresponding threaded portion on said neck; and means for sealing the fluid container opening when the dispenser is attached thereto;

wherein said pill dispenser has a cylindrical body, said cylindrical body having a longitudinal axis and being defined by first and second coaxial cylinders defining a cylindrical annular region therebetween, said second coaxial cylinder having a smaller diameter than said first coaxial cylinder, said cylindrical annular region being bounded at a first end thereof by an annular base and at a second end thereof by said means for opening and closing said at least one chamber; said chamber being defined between said cylinders and said base; and wherein said second coaxial cylinder has an interior wall surface and said means for attaching is disposed on said interior wall surface and for attaching said pill dispenser to the opening of said drinking fluid container such that said pill dispenser closes said opening when it is attached thereto.

2. The pill dispenser according to claim 1, wherein said means for attaching includes a threaded portion provided on said interior wall surface for threadably engaging said pill dispenser with a corresponding threaded portion on said opening.

3. The pill dispenser according to claim 2, wherein said drinking fluid container is a water bottle, and wherein said opening is at the an end of a threaded neck on said bottle.

4. The pill dispenser according to claim 2, wherein said pill dispenser includes a plurality of chambers for storing pills therein.

5. The pill dispenser according to claim 4, wherein said chambers are configured and dimensioned identically.

6. The pill dispenser according to claim 5, wherein said chambers are disposed symmetrically with respect to said longitudinal axis.

7. The pill dispenser according to claim 6, wherein said means for opening and closing includes a disc-shaped lid rotatably attached to said cylindrical body, said lid being provided with an opening therein, said lid further being rotatable about said longitudinal axis such that said lid opening is registrable with each of said chambers, said lid opening thereby allowing access to an interior space of any given one of said plurality of chambers.

8. The pill dispenser according to claim 7, wherein said pill dispenser comprises means for locking the lid opening into registration above any given chamber.

* * * * *